US011965719B2

(12) United States Patent
Hoelscher et al.

(10) Patent No.: US 11,965,719 B2
(45) Date of Patent: Apr. 23, 2024

(54) SEGMENT PRESSING OF SHAPED CHARGE POWDER METAL LINERS

(71) Applicant: Halliburton Energy Services, Inc., Houston, TX (US)

(72) Inventors: Christopher C. Hoelscher, Arlington, TX (US); Joseph Todd MacGillivray, Fort Worth, TX (US); James M. Barker, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 64 days.

(21) Appl. No.: 17/741,209

(22) Filed: May 10, 2022

(65) Prior Publication Data

US 2023/0364673 A1 Nov. 16, 2023

(51) Int. Cl.

| | |
|---|---|
| ***F42B 1/036*** | (2006.01) |
| ***B22F 3/02*** | (2006.01) |
| ***B22F 3/03*** | (2006.01) |
| ***B22F 3/06*** | (2006.01) |
| ***B22F 5/10*** | (2006.01) |

(Continued)

(52) U.S. Cl.

CPC ..... *F42B 1/032* (2013.01); *B22F 3/02* (2013.01); *B22F 3/03* (2013.01); *B22F 3/06* (2013.01); *B22F 5/10* (2013.01); *E21B 43/117* (2013.01); *F42B 1/028* (2013.01); *F42B 1/036* (2013.01); *F42B 33/025* (2013.01)

(58) Field of Classification Search

CPC .. F42B 1/02; F42B 1/028; F42B 1/032; F42B 1/036; F42B 3/08; F42B 12/10

USPC ..... 102/306, 307

See application file for complete search history.

(56) References Cited

U.S. PATENT DOCUMENTS

| | | | | |
|---|---|---|---|---|
| 6,012,392 A | | 1/2000 | Norman et al. | |
| 6,840,178 B2 * | | 1/2005 | Collins | F42B 1/028 102/307 |

(Continued)

FOREIGN PATENT DOCUMENTS

| | | | | |
|---|---|---|---|---|
| CN | 110145972 B | * | 6/2021 | E21B 43/119 |
| CN | 110145972 B | | 6/2021 | |

OTHER PUBLICATIONS

Machine translation of CN-110145972-B (Year: 2021).*

(Continued)

*Primary Examiner* — James S Bergin

(74) *Attorney, Agent, or Firm* — John Wustenberg; C. Tumey Law Group PLLC

(57) ABSTRACT

A shaped charge liner may include a plurality of liner segments for a shaped charge configured to perforate a sidewall of a wellbore upon detonation. The plurality of liner segments may include a tip liner segment comprising a first group of compacted metal powder having a hollow cone shape with a trailing interface end disposed opposite a tip end. The tip liner segment is configured to be disposed in a shaped charge casing of the shaped charge. The plurality of liner segments may also include a base liner segment comprising a second group of compacted metal powder having a truncated hollow cone shape with a trailing base end disposed opposite a leading base interface end. The trailing base end has a larger diameter than the leading base interface end, and the base liner segment is configured to be disposed at least partially within the shaped charge casing.

19 Claims, 11 Drawing Sheets

(51) Int. Cl.

| | |
|---|---|
| ***E21B 43/117*** | (2006.01) |
| ***F42B 1/028*** | (2006.01) |
| ***F42B 1/032*** | (2006.01) |
| *F42B 33/02* | (2006.01) |

(56) References Cited

U.S. PATENT DOCUMENTS

| | | | | |
|---|---|---|---|---|
| 9,441,924 | B1 * | 9/2016 | Frericks | F42B 1/028 |
| 9,612,095 | B2 * | 4/2017 | Smart | F42B 1/028 |
| 9,862,027 | B1 | 1/2018 | Loehken | |
| 10,227,851 | B2 * | 3/2019 | Collins | F42B 1/028 |
| 10,458,212 | B2 * | 10/2019 | Collins | E21B 43/117 |
| 10,830,023 | B2 * | 11/2020 | Yang | F42B 1/032 |
| 11,220,891 | B2 * | 1/2022 | Metzger | F42B 1/028 |
| 2022/0298895 | A1 * | 9/2022 | Wilson | F42B 1/028 |
| 2023/0052273 | A1 * | 2/2023 | Björkgren | F42B 12/18 |

OTHER PUBLICATIONS

International Search Report and Written Opinion for International Patent Application No. PCT/US2022/030194 dated Feb. 8, 2023.

* cited by examiner

SEGMENT PRESSING OF SHAPED CHARGE POWDER METAL LINERS

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. Traditionally the casing string is cemented to the wellbore. To access the hydrocarbons for production, a perforating gun system may be deployed into the casing string via a tool string. The tool string (e.g., a tubing string, wireline, slick line, coil tubing) lowers the perforating gun system into the casing string to a desired position within the wellbore. Once the perforating gun system is in position such that shaped charges are disposed adjacent to a subterranean formation having hydrocarbons, the shaped charges are detonated. The detonation perforates the casing string, the cementing, and the subterranean formation such that hydrocarbons may flow into the casing string via the perforation.

Traditionally, shaped charges include an explosive material that expels a metal liner outward in a jet to perforate a target material (e.g., casing string, cementing, subterranean formation) upon detonation. Various characteristics of the metal liner (e.g., material, shape, size, density, etc.) may affect velocity, momentum, length, and stability of the jet formation. For example, increasing the density at a tip of a liner and/or decreasing the density at a base of the liner may alter the velocity and momentum gradients of the jet. Having a high velocity jet may be ideal for penetrating relatively hard target materials. However, in some situations, having a higher density at a middle of the liner or at the base of the liner may be ideal for penetrating target materials.

Unfortunately, current manufacturing techniques, which include spinning metal powder in a centrifugal die and pressing the metal powder to form the liner, do not readily allow for intentional density variations in the liner. Indeed, spinning the metal powder tends to drive lower density particles outward such that the metal liners are generally denser proximate the tip of the liner, which may limit their effectiveness on some target materials.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for segmented shaped charges used in downhole perforating guns systems configured to perforate downhole materials (e.g., casing string, cementing, subterranean formation). In particular, the segmented shaped charges each comprise a plurality of liner segments. As set forth in detail below, the liner segments 312 may each be formed with specific characteristics (e.g., material, shape, size, density, etc.) and oriented within a corresponding shaped charge 120 such that the resulting shaped charge 120 liner may have a particular density gradient, as well as other characteristics, for perforating a target downhole material.

Figure 1:
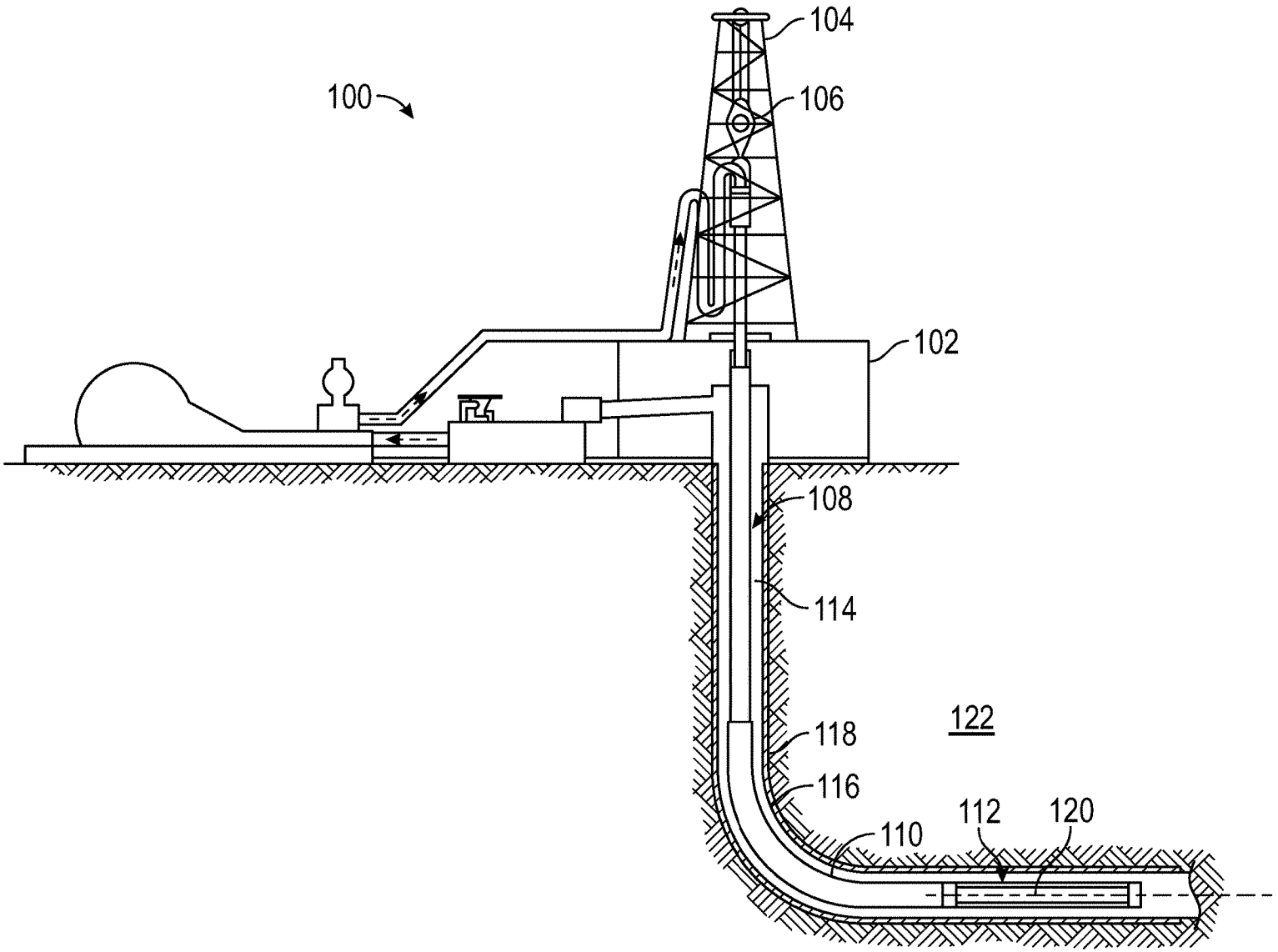
FIG. 1 illustrates a side elevation, partial cross-sectional view of an operational environment for a drilling and completion system, in accordance with some embodiments of the present disclosure.

FIG. 1 illustrates a side elevation, partial cross-sectional view of an operational environment for a drilling and completion system in accordance with one or more embodiments of the disclosure. It should be noted that while FIG. 1 generally depicts a land-based drilling and completion assembly, those skilled in the art will readily recognize that the principles described herein are equally applicable to subsea drilling and completion operations that employ floating or sea-based platforms and rigs, without departing from the scope of the disclosure. As illustrated, the drilling and completion assembly 100 includes a platform 102 that supports a derrick 104 having a traveling block 106 for raising and lowering a tool string 108. The tool string 108 includes, but is not limited to, a work string 110, a perforating gun system 112, and any other suitable tools, as generally known to those skilled in the art. While not shown, tubing string, wireline, slick line, and/or coil tubing may be used instead of work string 110 for supporting the perforating gun system 112.

The work string 110 is configured to lower the perforating gun system 112 into a wellbore 114. As illustrated, the wellbore 114 may be lined with casing 116 cemented to a wellbore wall 118. The casing 116 is configured to protect the wellbore 114 from failure (e.g., collapse, erosion) and to provide a fluid path for hydrocarbons during production. To access the hydrocarbons, the work string 110 lowers the perforating gun system 112 to a position such that shaped charges 120 are disposed adjacent to a subterranean formation 122 having the hydrocarbons, and the perforating gun system 112 detonates the shaped charges 120. In some embodiments, the shaped charges 120 may be detonated by the perforating gun system 112. The detonations perforate the casing 116, the cementing, and the subterranean formation 122 in the respective paths of the shaped charge 120 detonations such that hydrocarbons may flow into the casing 116 string via the perforations.

Figure 2:
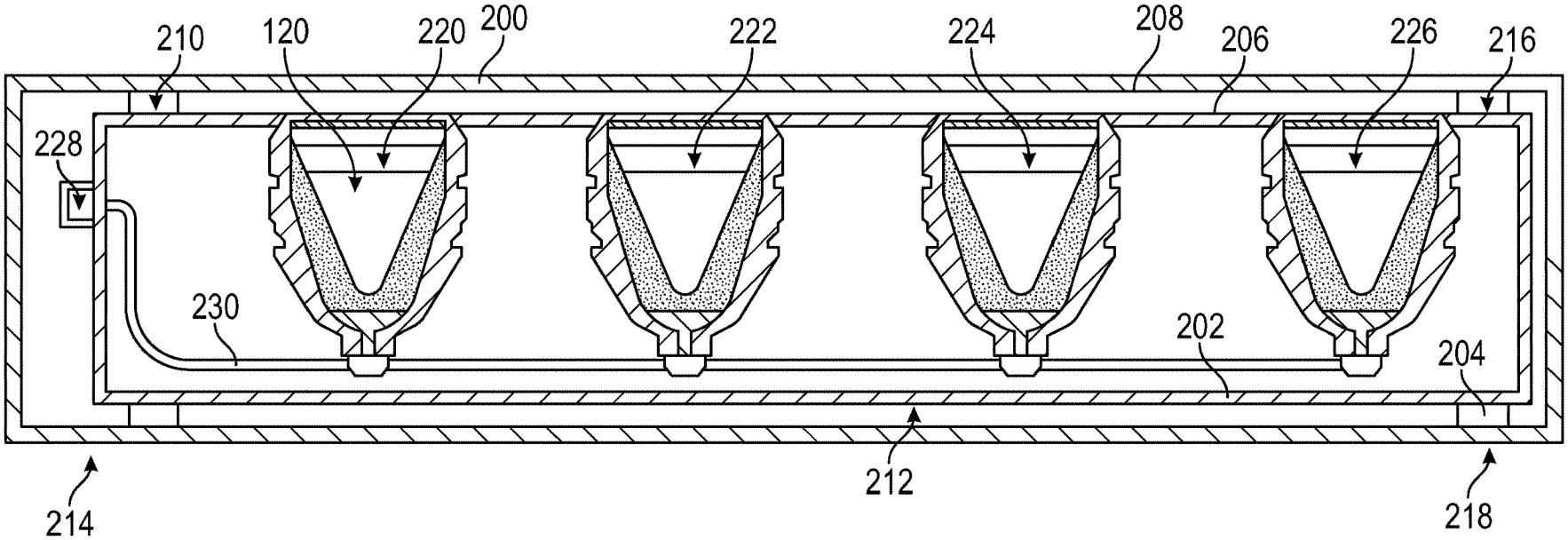
FIG. 2 illustrates a cross-sectional view of a downhole perforating gun system, in accordance with some embodiments of the present disclosure.

FIG. 2 illustrates a cross-sectional view of a downhole perforating gun system, in accordance with some embodiments of the present disclosure. The perforating gun system 112 includes the gun body 200 (e.g., gun carrier). The gun body 200 is configured to house a charge tube 202. In the illustrated embodiment, the charge tube 202 includes a generally cylindrical shape. However, the charge tube 202 may include any suitable shape. Further, the perforating gun system 112 may include a plurality of mounting devices 204 configured to mount the charge tube 202 within the gun body 200. The mounting devices 204 may radially secure the charge tube 202 within the gun body 200 to prevent the exterior surface 206 of the charge tube 202 from contacting the interior surface 208 of the gun body 200. In the illustrated embodiment, the mounting devices 204 include a first set of mounting devices 210 secured to an interior portion 212 of the gun body 200 proximate a first axial end 214 of the gun body 200 and a second set of mounting devices 216 secured to the interior portion 212 of the gun body 200 proximate a second axial end 218 of the gun body 200. In some embodiment, the perforating gun system 112 may include additional mounting devices 204 to further secure the charge tube 202.

Moreover, the perforating gun system 112 also includes the at least one shaped charge 120 (e.g., a first shaped charge 220, a second shaped charge 222, a third shaped charge 224, and a fourth shaped charge 226). The at least one shaped charge 120 may be mounted within the charge tube 202. At a desired location in the wellbore, the at least one shaped charge 120 is configured to detonate to perforate the casing 116, the cementing, and the subterranean formation 122. A detonating device 228 of the perforating gun system 112 may be configured to initiate detonation of the shaped charges 120. As illustrated, the detonating device 228 may include a detonating cord 230 connected to each shaped charge 120 mounted within the charge tube 202.

Figure 3:
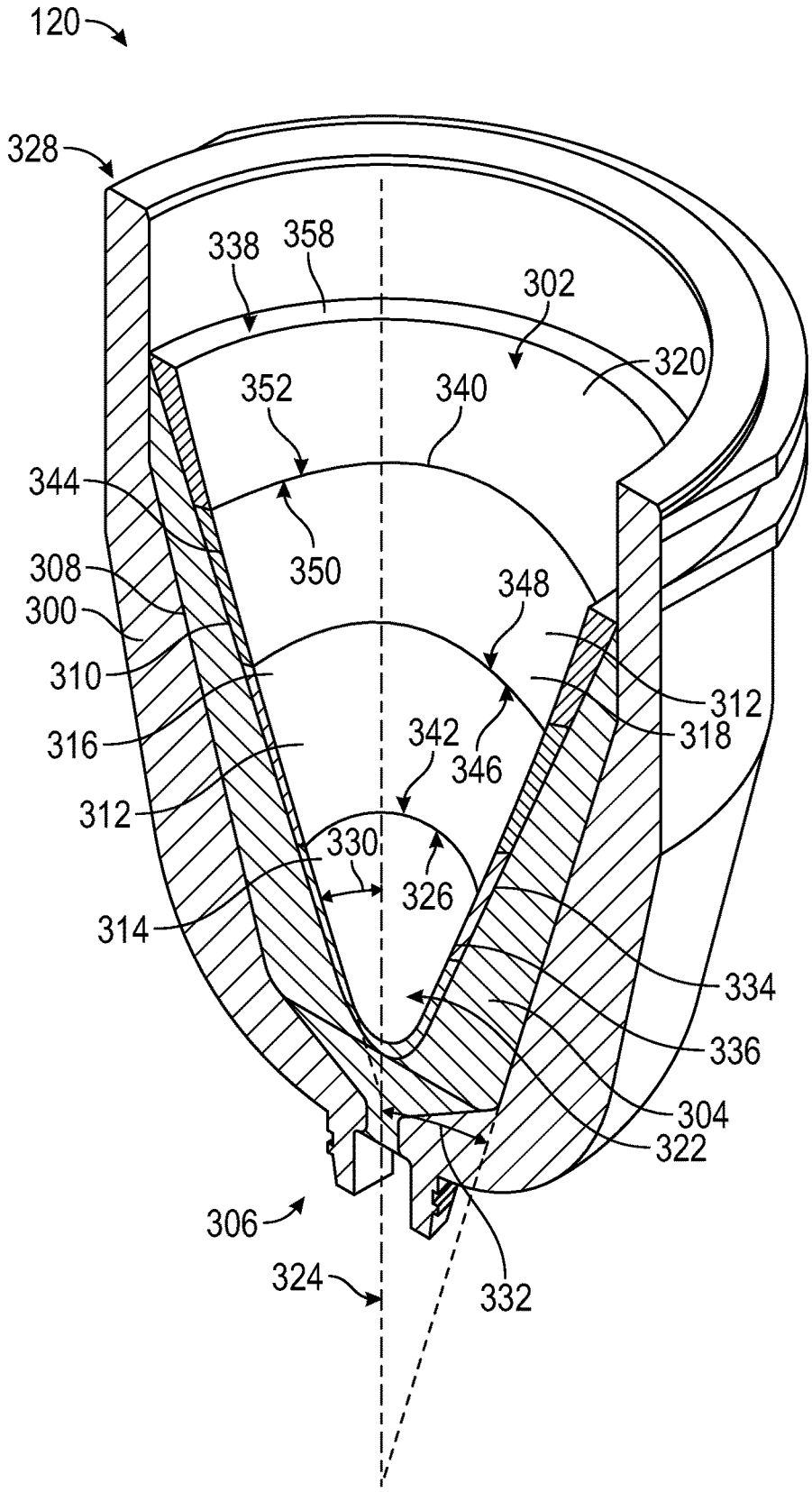
FIG. 3 illustrates a cutaway view of a shaped charge for the downhole perforating gun system, in accordance with some embodiments of the present disclosure.

FIG. 3 illustrates a cutaway view of a shaped charge 120 for the downhole perforating gun system, in accordance with some embodiments of the present disclosure. The shaped charge 120 includes a shaped charge casing 300 configured to house a segmented shaped charge liner 302, as well as an explosive material 304. The explosive material 304 may be disposed proximate an initiating end 306 of the shaped charge casing 300 in between an interior surface 308 of the shaped charge casing 300 and an exterior surface 310 of the segmented shaped charge liner 302. Upon detonation, the explosive material 304 is configured to collapse and expel the segmented shaped charge liner 302 in a jet to perforate a target material (e.g., a sidewall of the wellbore).

As illustrated, the segmented shaped charge liner 302 comprises a plurality of liner segments 312 configured to stack within the shaped charge casing 300. Each liner segment 312 may each be formed with specific characteristics (e.g., material, shape, size, density, density gradient, etc.) and oriented within the shaped charge casing 300 such that the segmented shaped charge liner 302 may have a particular density gradient, as well as other characteristics, for perforating a target downhole material. In the illustrated embodiment, the plurality of liner segments 312 includes a tip liner segment 314, a first intermediate liner segment 316, a second intermediate liner segment 318, and a base liner segment 320 that are stacked to form the segmented shaped charge liner 302 with a hollow conical shape. However, any suitable number of liner segments 312 may be used to form the segmented shaped charge liner 302. For example, the plurality of liner segments 312 may include only the tip liner segment 314 and the base liner segment 320. Alternatively, the plurality of liner segments 312 may include one or more intermediate liner segments stacked between the tip liner segment 314 and the base liner segment 320 to form the segmented shaped charge liner 302.

The tip liner segment 314 is configured to be disposed in the shaped charge casing 300 proximate the initiating end 306 of the shaped charge casing 300. The tip liner segment 314 comprises a first group 322 of compacted metal powder having a hollow cone shape with a tip end 324 and a trailing interface end 326 disposed opposite the tip end 324. The first group 322 of compacted metal powder may comprise a metal, a coated metal, or metal alloy powder selected from the group consisting of iron, steels, copper, brass, bronze, manganese, molybdenum, nickel, tungsten, bismuth, tin, lead, tantalum, aluminum, alloys thereof, and combinations thereof. A small amount of graphite may be included to act as a lubricant. Further, the first group 322 of compacted metal powder may be in a green state. That is, the first group 322 of metal powder is compacted into a desired shape, but not sintered or otherwise fused into a solid liner segment. Fusing the metal powder into a solid liner segment may adversely affect completion operations as the solid liner segment may leave behind a metal slug that blocks the hole formed by other portions of the segmented shaped charge liner 302.

Moreover, as illustrated, the tip liner segment 314 may be formed with a rounded tip end 324 having a radius between 0.03 to 0.5 inches (e.g., between 0.0762 to 1.27 centimeters). However, the tip end 324 may include any suitable shape. Further, the tip end 324 may be disposed more proximate the initiating end 306 of the of the shaped charge casing 300 than the trailing interface end 326 of the tip liner segment 314 such that a diameter (e.g., an inner and/or outer diameter) of the tip liner segment 314 increases in a direction toward a base casing end 328 of the shaped charge casing 300. The diameter of the tip liner segment 314 may increase based at least in part on a slant angle 330 of the tip liner segment 314. In particular, a higher slant angle 330 may result in a larger diameter of the tip liner segment 314 at the trailing interface end 326. The slant angle 330 of the tip liner segment 314 may be between 10.0 to 45.0 degrees. Further, the slant angle 330 of the tip liner segment 314 may be greater than a casing slant angle 332 of the shaped charge casing 300 such that a radial width of the gap between an exterior surface 334 of the tip liner segment 314 and the interior surface 308 of the shaped charge casing 300 decreases in the direction toward the trailing interface end 326 of the tip liner segment 314.

An axial length of the tip liner segment 314, from the tip end 324 to the trailing interface end 326, may be between 12.0 to 50.0 percent of a combined axial length of the plurality of liner segments 312 for a segmented shaped charge liner 302 having two to eight liner segments 312. However, in some embodiments, the axial length of the tip liner segment 314 may be between 15.0 to 35.0 percent of a combined axial length of the plurality of liner segments 312 for a segmented shaped charge liner 302 having two to eight liner segments 312. Moreover, an axial length of each liner segment of the plurality of liner segments 312 may be between 12.0 to 50.0 percent of a combined axial length of the plurality of liner segments 312 for a segmented shaped charge liner 302 having two to eight liner segments 312. However, the axial length of each liner segment may be greater (e.g., between 30.0 to 60.0 percent) for a segmented shaped charge liner 302 having two or three liner segments 312 and less (e.g., between 10.0 to 25.0 percent) for a segmented shaped charge liner 302 having more than four liner segments 312. Further, each of the liner segments 312 may have a distinct axial length based at least in part on a desired density gradient profile for the segmented shaped charge liner 302. For example, in the illustrated embodiment, the axial lengths of the liner segments 312 progressively decrease from the tip liner segment 314 toward the base liner segment 320 such that the density of the segmented shaped charge liner 302 proximate the tip liner segment 314 is greater than the density proximate the base liner segment 320. Alternatively, each of the liner segments 312 may have the same axial length.

An average thickness of the tip liner segment 314 may be between 0.015 to 0.150 inches (e.g., between 0.0381 to 0.381 centimeters). As set forth above, the tip liner segment 314 comprises a hollow cone shape. The thickness of the tip liner segment 314 may be measured between an interior surface 336 of the tip liner segment 314 and the exterior surface 334 of the tip liner segment 314. In some embodiments, the thickness of the tip liner segment 314 may increase in the axial direction from the tip end 324 toward the trailing interface end 326. Alternatively, the tip liner segment 314 may have a uniform thickness. Moreover, an average thickness of each liner segment may be between 0.015 to 0.250 inches (e.g., 0.0381 to 0.635 centimeters). In some embodiments, the average thickness of each liner segment 312 may increase toward a base end 338 of the segmented shaped charge liner 302. For example, as illustrated, the respective average thicknesses may be 0.035 inches (e.g., 0.0889 centimeters) for the tip liner segment 314, 0.036 inches (e.g., 0.09144 centimeters) for the first intermediate liner segment 316, 0.05 inches (e.g., 0.127 centimeters) for the second intermediate liner segment 318, and 0.065 inches (e.g., 0.1651 centimeters) for the base liner segment 320. However, a thickness at each end of the respective liner segments 312 may be the same as a corresponding end of an adjacent liner segment for interfacing purposes.

Each liner segment 312 may have at least one interface end 340 configured to interface with a corresponding interface end of an adjacent liner segment. For example, in the illustrated embodiment, the tip liner segment 314 comprises the trailing interface end 326 mated with a leading first intermediate interface end 342. The trailing interface end 326 and the leading first intermediate interface end 342 may have the same inner and outer diameters such that the respective interface ends 340 may be aligned and form the continuous interior surface 344 and exterior surface 310 for the segmented shaped charge liner 302 between the adjacent liners 312. Further, a trailing first intermediate interface end 346 of the first intermediate liner segment 316 may be mated with a leading second intermediate interface end 348 of the second intermediate liner segment 318, and a trailing second intermediate interface end 350 of the second intermediate liner segment 318 may be mated with a leading base interface end 352 of the base liner segment 320. Alternatively, for an embodiment having only the tip liner segment 314 and the base liner segment 320, the trailing interface end 326 of the tip liner segment 314 may be mated with the leading base interface end 352 of the base liner segment 320.

Moreover, as set forth above, the plurality of liner segments 312 may include at least one intermediate liner segment disposed between the tip liner segment 314 and the base liner segment 320. In the illustrated embodiment, the at least one intermediate liner segment includes the first intermediate liner segment 316, disposed adjacent the tip liner segment 314, and the second intermediate liner segment 318 disposed adjacent the base liner segment 320. The at least one intermediate liner segment comprises a second group 354 of compacted metal powder having a truncated hollow cone shape with a leading intermediate interface end (e.g., the leading first intermediate interface end 342) and a trailing intermediate interface end (e.g., the trailing first intermediate interface end 346). The second group 354 of compacted metal powder may comprise a metal or metal alloy powder selected from the group consisting of iron, steels, copper, brass, bronze, manganese, molybdenum, nickel, tungsten, bismuth, tin, lead, tantalum, aluminum, alloys thereof, and combinations thereof. The second group 354 of compacted metal powder may have the same metal or metal alloy as the first group 322 of compacted metal powder. Alternatively, the second group 354 of compacted metal powder may include a different metal or metal alloy than the first group 322 of compacted metal powder. Further, the second group 354 of compacted metal powder may be in a green state. Additionally, as the at least one intermediate liner segment has a truncated hollow cone shape, the leading intermediate interface end and the trailing intermediate interface end may each have an annular or ring-shaped cross-section. Additionally, the trailing intermediate interface end has a larger diameter than the leading intermediate interface end.

Further, the plurality of liner segments 312 includes the base liner segment 320, which comprises a third group 356 of compacted metal powder having a truncated hollow cone shape. The third group 356 of compacted metal powder may comprise a metal or metal alloy powder selected from the group consisting of iron, steels, copper, brass, bronze, manganese, molybdenum, nickel, tungsten, bismuth, tin, lead, tantalum, aluminum, alloys thereof, and combinations thereof. The third group 356 of compacted metal powder may have the same metal or metal alloy as the first group 322 and/or second group 354 of compacted metal powder. For example, the first group 322, second group 354, and third group 356 of compacted metal powder may each include copper and tungsten materials, perhaps in different proportions. Alternatively, the third group 356 of compacted metal powder may include a different metal or metal alloy than the first group 322 and/or second group 354 of compacted metal powder. For example, the first group 322 of compacted metal powder may include a copper and tungsten material, and the second group 354 and third group 356 of compacted metal powders may each include a steel material. Further, the base liner segment 320 includes the leading base interface end 352 and a trailing base end 358, each having an annular or ring-shaped cross-section. The trailing base end 358 may have a larger diameter than the leading base interface end 352. In some embodiments, an outer diameter at the trailing base end 338 of the base liner segment 320 may be sufficiently large such that an outer surface of the base liner segment 320 contacts the interior surface 308 of the shaped charge casing 300. Such contact may at least partially seal the explosive material 304 from the base casing end 328 of the shaped charge casing 300.

Figure 4B:
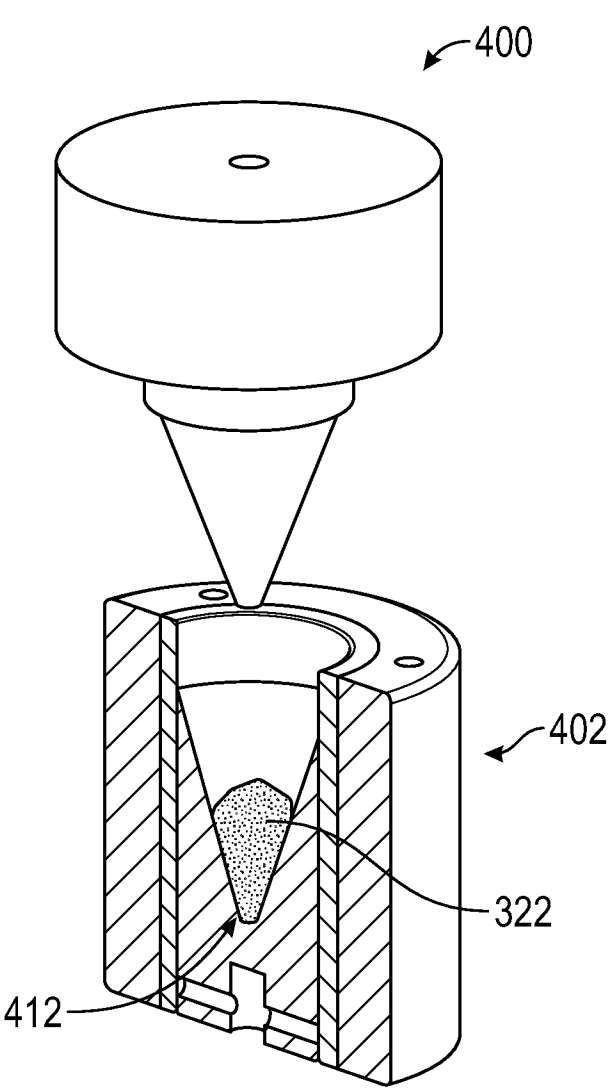
FIGS. 4A-4E illustrate various views of a tip press assembly forming a tip liner segment for the shaped charge, in accordance with some embodiments of the present disclosure.
Figure 4A:
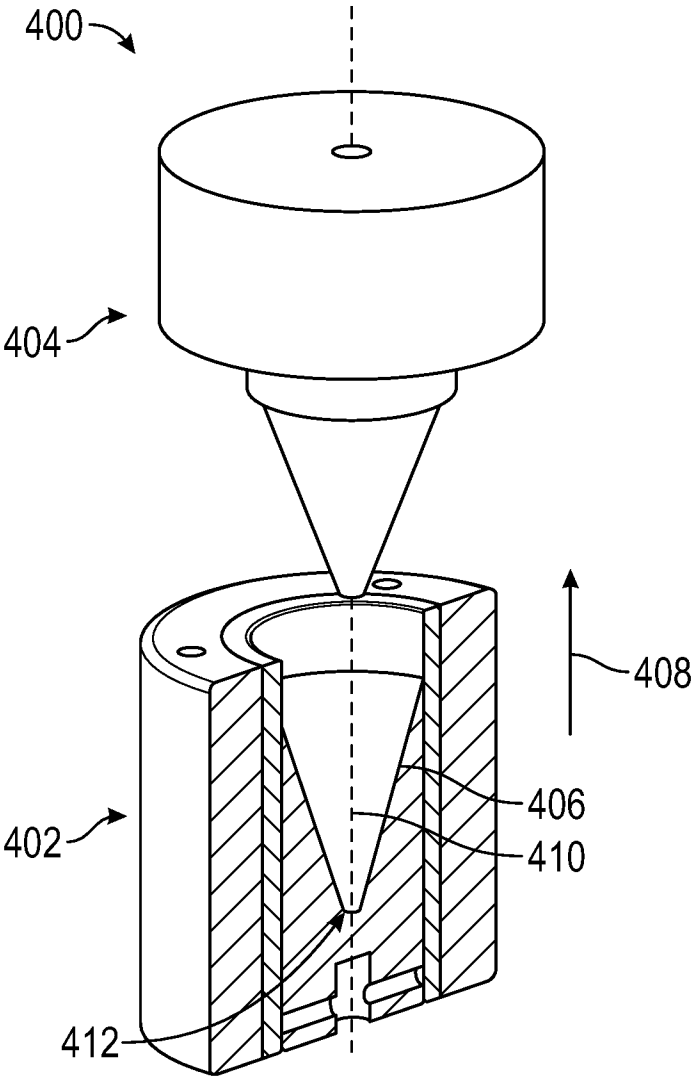

FIGS. 4A-4E illustrate various views of a tip press assembly 400 forming a tip liner segment 314 for the shaped charge, in accordance with some embodiments of the present disclosure. In particular, FIG. 4A illustrates a cutaway view of a tip press assembly 400 for forming the tip liner segment 314. As illustrated, the tip press assembly 400 includes a tip die 402 and a tip punch 404. The tip die 402 may be a cone-shaped tip die 402 configured to receive a corresponding cone-shaped tip punch 404 to form a tip liner segment 314 having a hollow cone shape. In the illustrated embodiment, the tip die 402 is oriented such that the diameter of an inner wall 406 of the tip die 402 increases in a upward direction 408. That is, the inner wall 406 of the tip die 402 may be angled with respect to a central axis 410 of the tip die 402 such that the tip die 402 may form the tip liner segment 314 with a hollow cone shape. Further, a bottom of the tip die 402 may be rounded such that the tip end 324 of the tip liner segment 314 may be a rounded tip end 324. However, the bottom of the tip die 402 may have any suitable shape for forming the tip end 324 of the tip liner segment 314.

FIG. 4B illustrates the tip press assembly 400 having received the first group 322 of metal powder, in accordance with some embodiments of the present disclosure. As illustrated, the tip die 402 (e.g., cone-shaped tip die 402) is configured to receive the first group 322 of metal powder. A desired amount of the first group 322 of metal powder may be placed into the tip die 402. As set forth above, the first group 322 of metal powder may comprise a metal or metal alloy powder selected from the group consisting of iron, steels, copper, brass, bronze, manganese, molybdenum, nickel, tungsten, bismuth, tin, lead, tantalum, aluminum, alloys thereof, and combinations thereof. Further, the first group of metal powder may settle proximate the bottom 412 of the tip die 402.

Figure 4E:
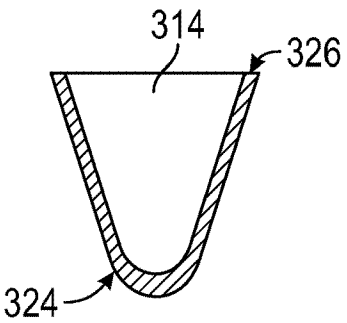
Figure 4D:
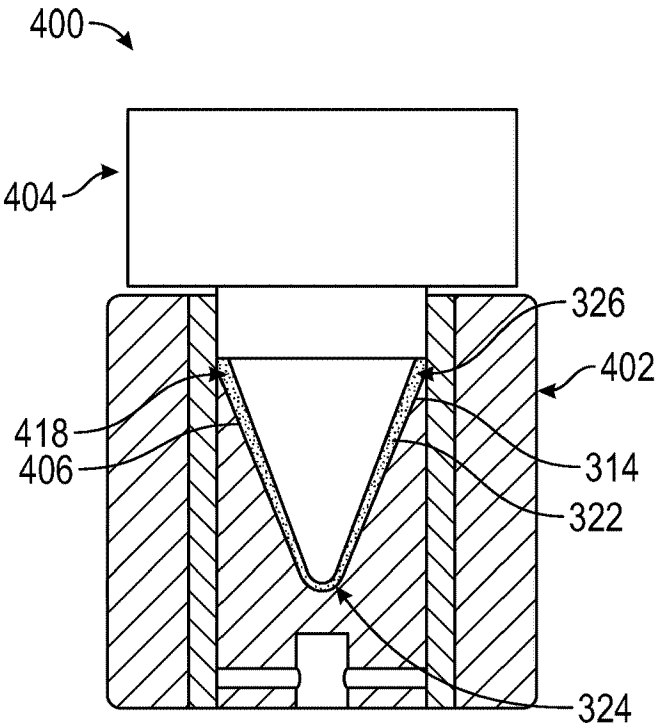
Figure 4C:
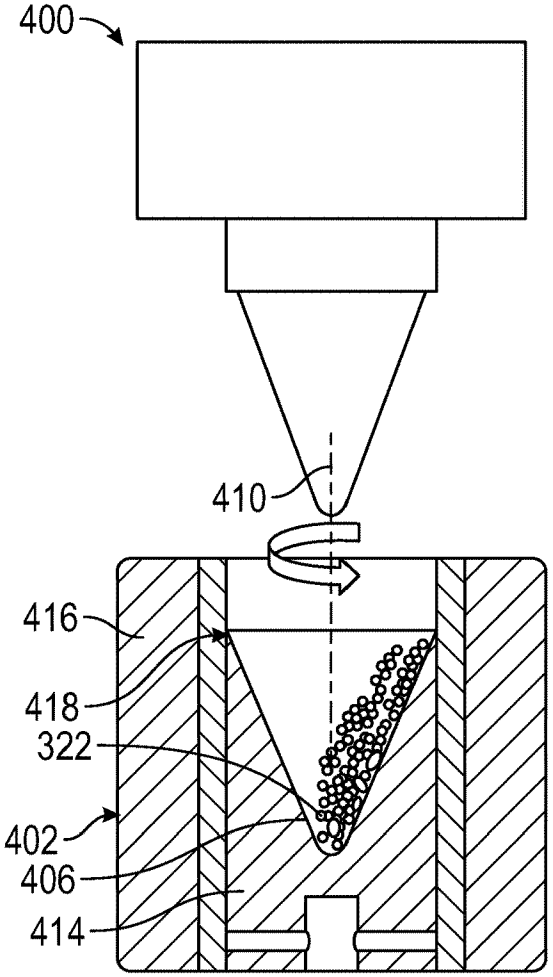

FIG. 4C illustrates the tip press assembly 400 with the tip die 402 rotating, in accordance with some embodiments of the present disclosure. The tip die 402 may include a die portion 414 rotatably housed within an outer housing 416. That is, the die portion 414 may be configured to rotate within the outer housing 416 about the central axis 410 of the tip die 402. Additionally, the tip die 402 may comprise an actuator (not shown) configured to drive rotation of the die portion 414 with respect to the outer housing 416. Rotating the die portion 414 may drive the first group 322 of metal powder out and up the inner wall 406 of the die portion 414 of the tip die 402 via centrifugal force. Driving the first group 322 of metal powder out and up the inner wall 406 via centrifugal force may segregate metal particles of the first group 322 of metal powder by density. In particular, lower density particles may be driven toward an upper end of the inner wall 406.

FIG. 4D illustrates the tip press assembly 400 with the tip punch 404 compressing the first group 322 of metal powder against the tip die 402, in accordance with some embodiments of the present disclosure. Indeed, the tip punch 404 (e.g., the cone-shaped tip punch 404) is configured to press the first group 322 of metal powder against the inner wall 406 of the tip die 402 (e.g., cone-shaped tip die 402) to compact the first group 322 of metal powder and form the tip liner segment 314 having a hollow cone shape. As set forth above, the first group 322 of compacted metal powder may be in a green state. That is, the first group 322 of metal powder may be compacted into the desired hollow cone shape, but not sintered or otherwise fused into a solid liner segment. Further, the tip punch 404 may be configured to press the first group 322 of metal powder against the inner wall 406 after rotating or during rotation of the tip die 402, such that the lower density particles of the first group 322 of metal powder are disposed proximate the upper end 418 of the inner wall 406. Compressing the first group 322 of metal powder as the tip die 402 is rotating or after rotation may form the tip liner segment 314 with a density gradient along the axial length of the tip liner segment 314 with the density of the tip liner segment 314 proximate the trailing interface end 326 being less than the density proximate the tip end 324.

FIG. 4E illustrates the tip liner segment 314 formed via the tip press assembly 400. As illustrated, the tip liner segment 314 has a hollow cone shape. Further, as set forth above, the tip liner segment 314 may have a density gradient along its axial length. In particular, the density of the tip liner segment 314 may decrease in the direction from the tip end 324 toward the trailing interface end 326. However, in some embodiments, the tip press assembly 400 may be vertically inverted such that spinning the metal powder, via the tip die 402, may drive lower density metal powders toward the tip end 324 of the tip liner segment 314. In such an embodiment, the tip liner segment 314 may have a density gradient with the density decreasing in the direction from the trailing interface end 326 toward the tip end 324.

FIGS. 5A-5E illustrate various views of a base press assembly 500 forming the base liner segment 320 for the segmented shaped charge liner 302, in accordance with some embodiments of the present disclosure. Generally, a plurality of press assemblies with respective presses and dies may be used to form the segmented shaped charge liner 302. For example, the plurality of press assemblies may include the tip press assembly 400 set forth above, a first intermediate press assembly, a second intermediate press assembly, and the illustrated base press assembly 500. However, any suitable press assemblies may be used to form the plurality of liner segments 312 for the segmented shaped charge liner 302. As set forth above, the tip press assembly 400 may comprise the cone-shaped tip die 402 configured to receive the corresponding cone-shaped tip punch 404 to form the tip liner segment 314 having a hollow cone shape. Further, the first intermediate press assembly may comprise a first truncated cone shaped intermediate die configured to receive a first truncated cone shaped intermediate punch to form a first intermediate liner segment 316 having a truncated hollow cone shape. The second intermediate press assembly may comprise a second truncated cone shaped intermediate die configured to receive a second truncated cone shaped intermediate punch to form a second intermediate liner segment 318 having a truncated hollow cone shape. Additionally, as illustrated, the base press assembly 500 may comprise a truncated cone-shaped base die 502 configured to receive a truncated cone-shaped base punch 504 to form the base liner segment 320 with a truncated hollow cone shape. Each of the press assemblies may be configured to form a respective liner segment of the plurality of liner segments 312, which are configured to stack within the shaped charge casing 300 to form the segmented shaped charge liner 302.

Figure 5B:
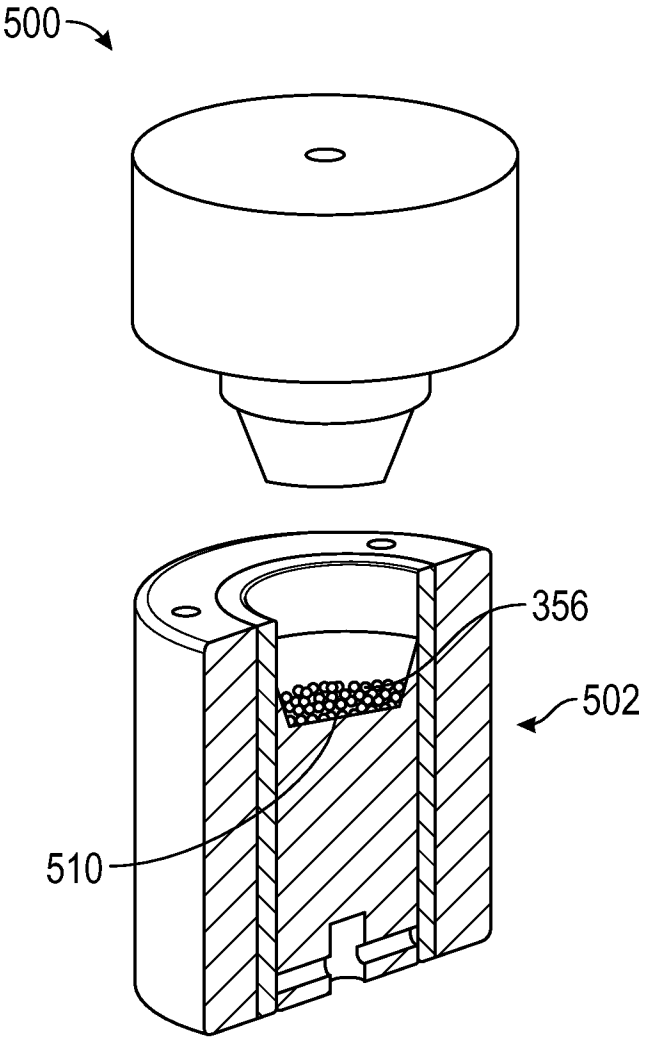
FIGS. 5A-5E illustrate various views of a base press assembly forming a base liner segment for the shaped charge, in accordance with some embodiments of the present disclosure.
Figure 5A:
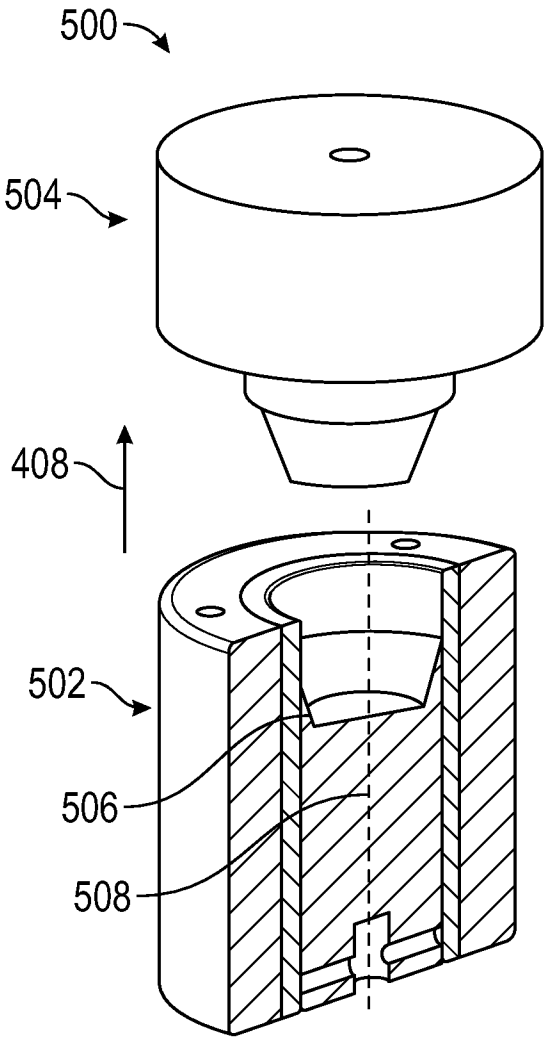

FIG. 5A illustrates a cutaway view of the base press assembly 500 for forming the base liner segment 320. As illustrated, the base press assembly 500 includes the base die 502 and the base punch 504. The base die 502 may be a truncated cone-shaped tip die 402 configured to receive a corresponding truncated cone-shaped base punch 504 to form the base liner segment 320 having a hollow truncated cone shape. In the illustrated embodiment, the base die 502 is oriented such that the diameter of an inner base wall 506 of the base die 502 increases in the upward direction 408. That is, the inner base wall 506 of the base die 502 may be angled with respect to a central axis 508 of the base die 502 such that the base die 502 may form the base liner segment 320 with a truncated hollow cone shape.

FIG. 5B illustrates the base press assembly 500 having received the third group 356 of metal powder, in accordance with some embodiments of the present disclosure. As illustrated, the base die 502 (e.g., a truncated cone-shaped base die) is configured to receive the third group 356 of metal powder. A desired amount of the third group 356 of metal powder may be placed into the base die 502. As set forth above, the third group 356 of metal powder may comprise a metal or metal alloy powder selected from the group consisting of iron, steels, copper, brass, bronze, manganese, molybdenum, nickel, tungsten, bismuth, tin, lead, tantalum, aluminum, alloys thereof, and combinations thereof. Further, the third group 356 of metal powder may settle proximate a bottom 510 of the base die 502.

Figure 5E:
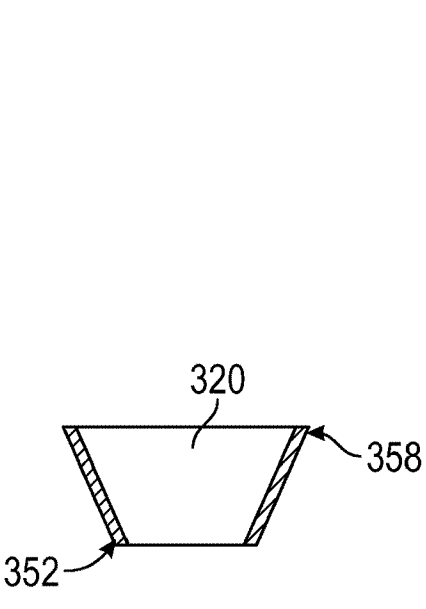
Figure 5D:
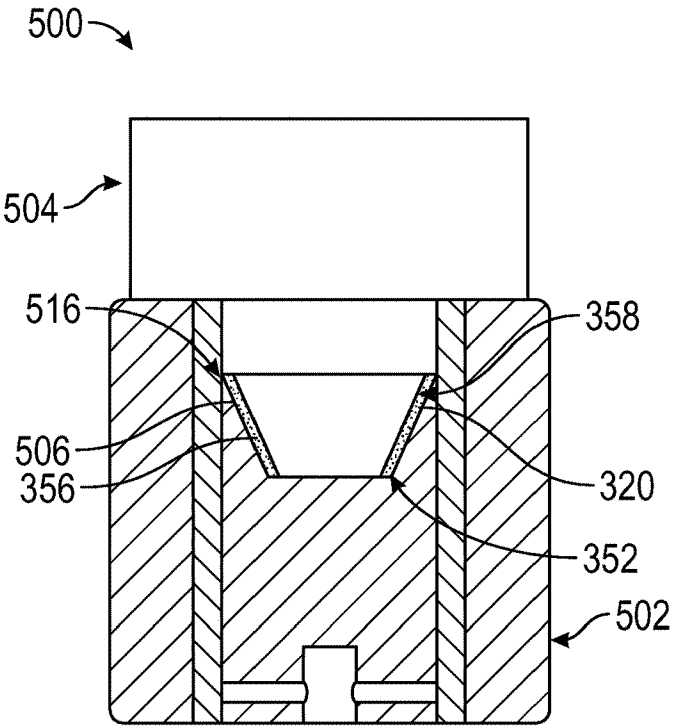
Figure 5C:
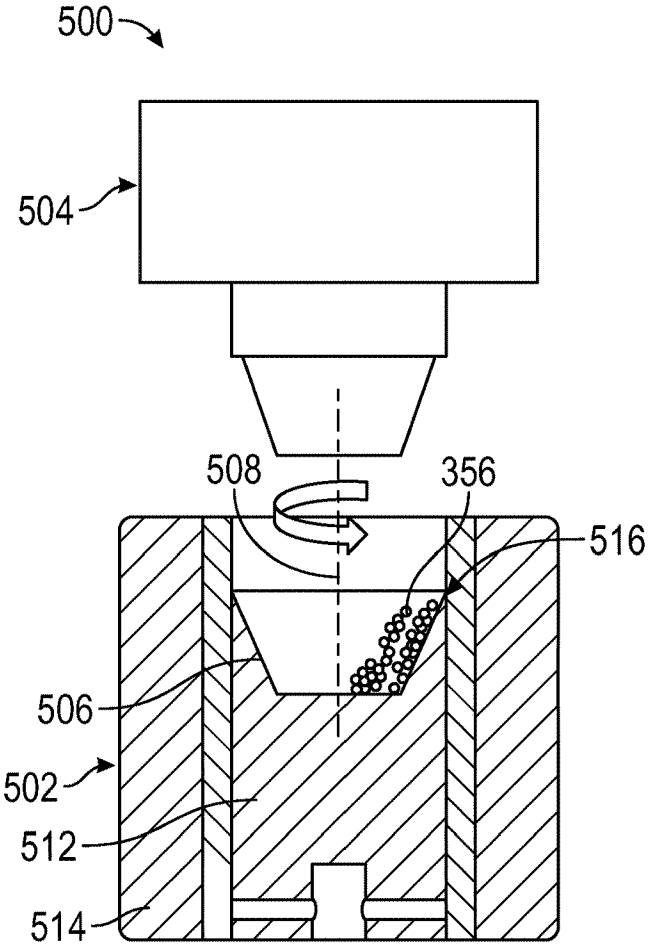

FIG. 5C illustrates the base press assembly 500 with the base die 502 rotating, in accordance with some embodiments of the present disclosure. The base die 502 may include a base die portion 512 rotatably housed within a base outer housing 514. That is the base die portion 512 may be configured to rotate within the base outer housing 514 about the central axis 508 of the base die 502. Additionally, the base die 502 may comprise a base actuator configured to drive rotation of the base die portion 512 with respect to the base outer housing 514. Rotating the base die portion 512 may drive the third group 356 of metal powder out and up the inner base wall 506 of the base die portion 512 of the base die 502 via centrifugal force. Driving the third group 356 of metal powder out and up the inner base wall 506 via centrifugal force may segregate metal particles of the third group 356 of metal powder by density. In particular, lower density particles may be driven toward an upper end 516 of the inner base wall 506.

FIG. 5D illustrates the base press assembly 500 with the base punch 504 compressing the third group 356 of metal powder against the base die 502, in accordance with some embodiments of the present disclosure. Indeed, the base punch 504 (e.g., a truncated cone-shaped base punch) is configured to press the third group 356 of metal powder against the inner base wall 506 of the base die 502 (e.g., a truncated cone-shaped base die) to compact the third group 356 of metal powder and form the base liner segment 320 having a truncated hollow cone shape. As set forth above, the third group 356 of compacted metal powder may be in a green state. That is, the third group 356 of metal powder may be compacted into the desired hollow truncated cone shape, but not sintered or otherwise fused into a solid liner segment. Further, the base punch 504 may be configured to press the third group 356 of metal powder against the inner base wall 506 duration or after rotation of the base die 502 such that the higher density particles of the third group 356 of metal powder are disposed proximate the upper end 516 of the inner base wall 506. Compressing the third group 356 of metal powder during or after rotation of the base die 502 may form the base liner segment 320 with a density gradient along the axial length of the base liner segment 320 with the density of the base liner segment 320 proximate the trailing base end 358 being less than the density proximate the leading base interface end 352.

FIG. 5E illustrates the base liner segment 320 formed via the base press assembly 500. As illustrated, the base liner segment 320 has a truncated hollow cone shape. Further, as set forth above, the base liner segment 320 may have a density gradient along its axial length. In particular, the density of the base liner segment 320 may increase in the direction from the leading base interface end 352 toward the trailing base end 358. However, in some embodiments, the base press assembly 500 may be vertically inverted such that spinning the third group 356 of metal powder, via the base die 502 assembly, may drive higher density metal powders toward the leading base interface end 352 of a base liner segment 320 formed by the base die 502. In such an embodiment, the base liner segment 320 may have a density gradient with the density decreasing in the direction from the trailing base end 358 toward the leading base interface end 352.

Figure 6:
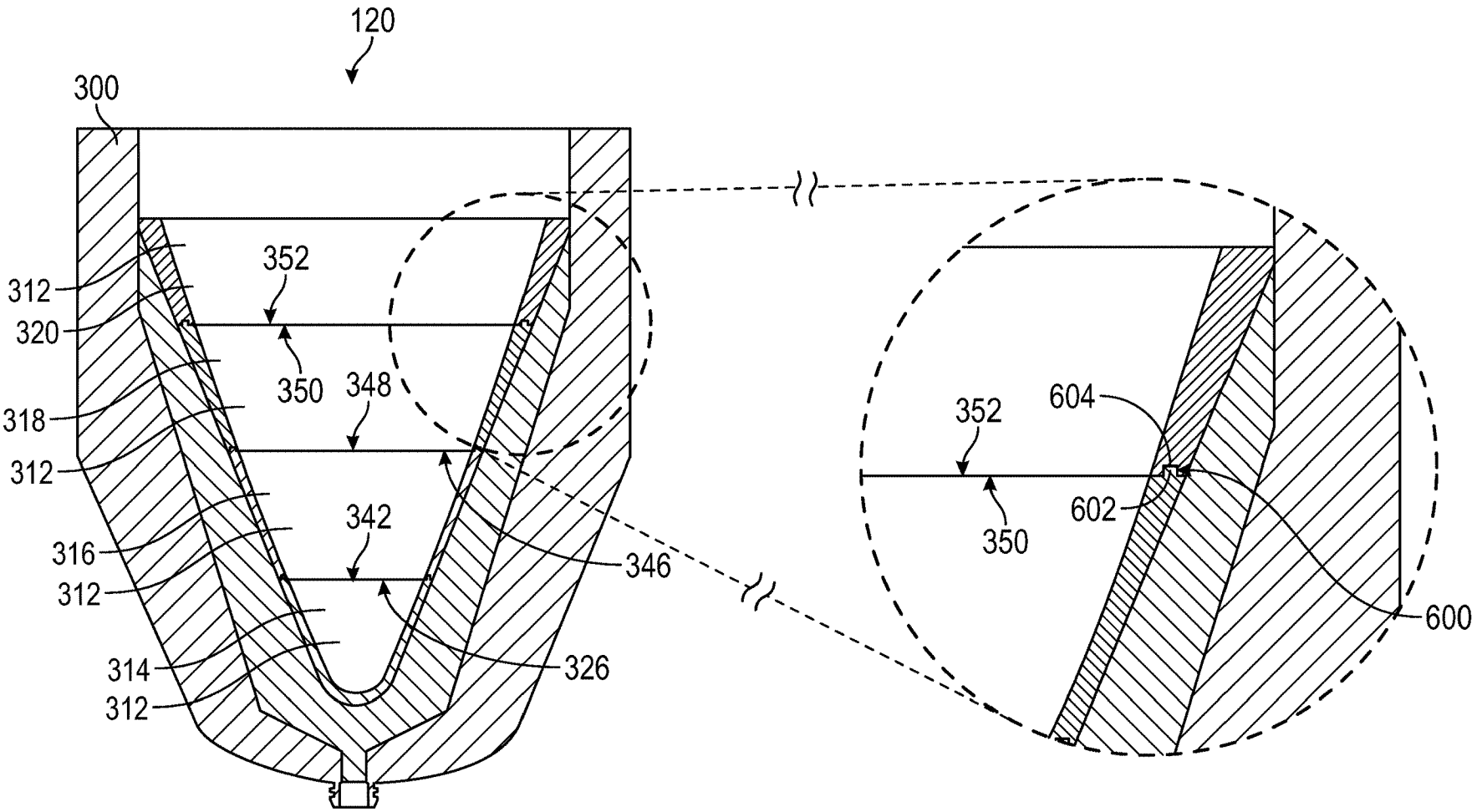
FIG. 6 illustrates a cross-sectional view of the shaped charge having a plurality of liner segments with interface features, in accordance with some embodiments of the present disclosure.

FIG. 6 illustrates a cross-sectional view of the shaped charge 120 having a plurality of liner segments 312 with interface features, in accordance with some embodiments of the present disclosure. As set forth above, the plurality of liner segments 312 may be configured to stack in the shaped charge casing 300 to form a hollow cone shape liner. Indeed, a method for forming the segmented liner may include the step of stacking each of the liner segments 312 in the shaped charge casing 300. In the illustrated embodiment, the first intermediate liner segment 316 is stacked on top of the tip liner segment 314 with the leading first intermediate interface end 342 mated against the trailing interface end 326 of the tip liner segment 314. Further, the second intermediate liner segment 318 is stacked on top of the first intermediate liner segment 316 with the leading second intermediate interface end 348 mated against the trailing first intermediate interface end 346, and the base liner segment 320 is stacked on top of the second intermediate liner segment 318 with the leading base interface end 352 mated against the trailing second intermediate interface end 350.

Moreover, as illustrated, each liner segment of the plurality of liner segments 312 comprises at least one interface feature 600 configured to interface with a corresponding interface feature of an adjacent liner segment in the shaped charge casing 300 to restrain at least lateral movement between the liner segment and the adjacent liner segment. The at least one interface feature 600 of each liner segment 312 may include a protrusion, a recess, or some combination thereof. For example, the trailing second intermediate interface end 350 of the second intermediate liner segment 318 may comprise a protrusion 602 (e.g., a ridge) extending out from a surface of the trailing second intermediate interface end 350 and about at least a portion of the circumference of the trailing second intermediate interface end 350. Further, the leading base interface end 352 of the base liner segment 320 may comprise a corresponding recess 604 (e.g., channel) extending into a surface of the leading base interface end 352 and about at least a portion of the circumference of the leading base interface end 352. When stacking the base liner segment 320 on the second intermediate liner segment 318, the protrusion 602 of the second intermediate liner segment 318 may extend into the recess 604 of the base liner segment 320. Such interface features 600 may at least partially restrain lateral movement between the second intermediate liner segment 318 and the base liner segment 320.

Moreover, as set forth above, each liner segment of the plurality of liner segments 312 may comprise a density gradient along an axial length of the liner segment. Each liner segment may have a leading end (e.g., tip end 324, leading first intermediate interface end 342, etc.) and a trailing end (e.g., trailing interface end 326, trailing first intermediate interface end 346, etc.). Generally, the trailing end has a larger diameter than the leading end. The density gradient for each liner segment may include a first mean density between 0.3613 to 0.7948 pounds per cubic inch [e.g., between 10.0 to 22.0 grams/cubic centimeters ($g/cm^3$)] at the leading end of each liner segment and a second mean density at the trailing end of each liner segment. The second mean density may be between 95 to 99 percent of the density of the first mean density. For example, the density gradient for a liner segment may include the first mean density of 10.0 $g/cm^3$ at the leading end and the second mean density of 9.5 g/cm$^3$ at the trailing end. Alternatively, the plurality of liner segments may be inverted such that first mean density is between 95 to 100 percent of the density of the second mean density. The density gradient along the axial length of the liner segments 312 may comprise a gradual transition from the first mean density to the second mean density.

Figure 7B:
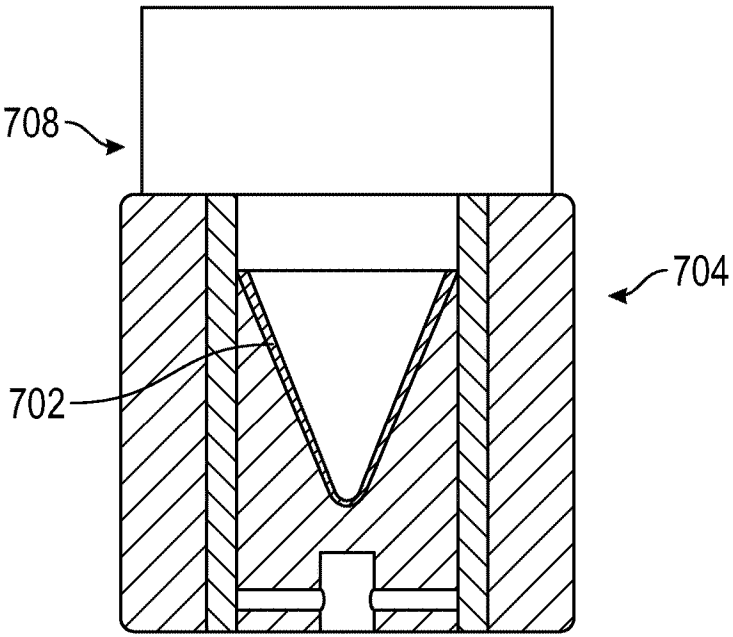
FIGS. 7A-7B illustrate cross-sectional views of a secondary press assembly configured to press a plurality of liner segments into a continuous liner, in accordance with some embodiments of the present disclosure.
Figure 7A:
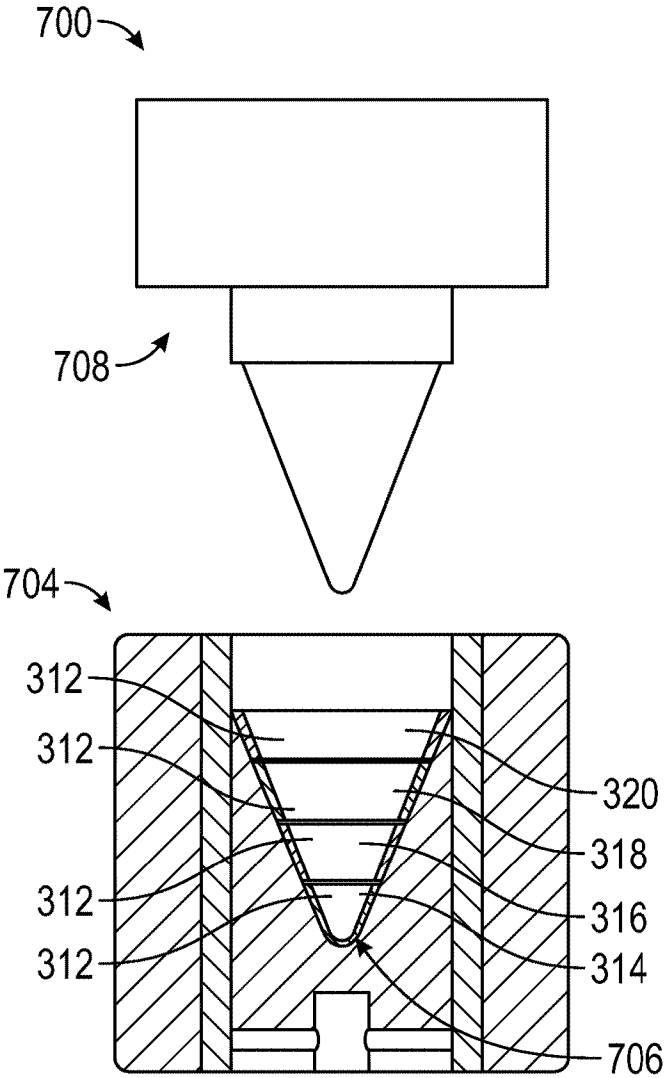

FIGS. 7A-7B illustrate cross-sectional views of a secondary press assembly 700 configured to press a plurality of liner segments 312 into a continuous liner, in accordance with some embodiments of the present disclosure. In some embodiments, the plurality of liner segments 312 may be pressed into a single continuous liner 702 prior to placement in the shaped charge housing. Referring to FIG. 7A, the plurality of liner segments 312 may be stacked within a secondary cone-shaped die 704 of the secondary press assembly 700 such that the stacked liner segments 312 form a hollow cone shape. For example, the tip liner segment 314 may be placed proximate a bottom 706 of the secondary cone-shaped die 704, the first intermediate liner segment 316 may be stacked on top of the tip liner segment 314, the second intermediate liner segment 318 may be stacked on the first intermediate liner segment 316, and the base liner segment 320 may be stack on the second intermediate liner segment 318. Referring to FIG. 7B, the secondary press includes a secondary cone-shaped punch 708. The plurality of liner segments 312 may be merged or pressed into the continuous liner 702 via driving the secondary cone shaped punch 708 into the secondary cone shaped die 704. Specifically, the secondary cone shaped punch 708 may compress the plurality of liner segments 312 into each other, as well as into the secondary cone-shaped die 704 such that the plurality of liner segments 312 merge into the single continuous liner 702, which may then be placed in the shaped charge casing 300.

Figure 8:
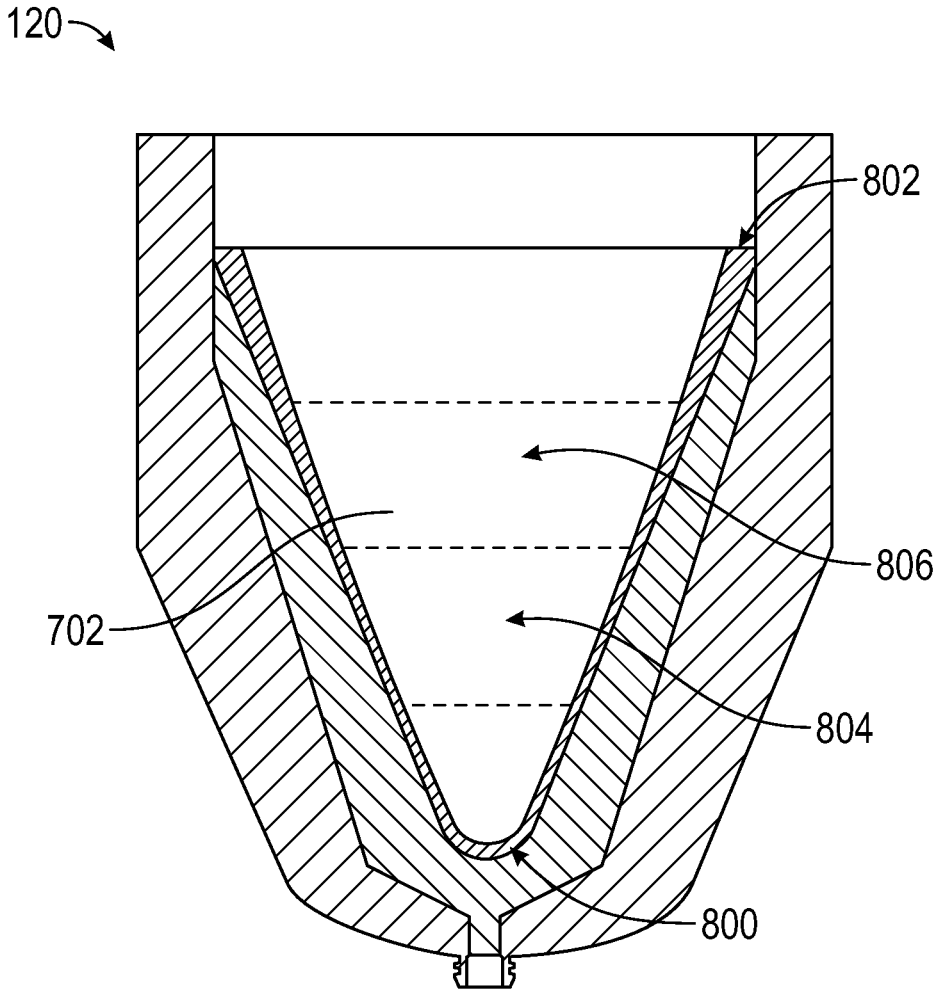
FIG. 8 illustrates a cross-sectional view of the continuous liner disposed in the shaped charge, in accordance with some embodiments of the present disclosure.

FIG. 8 illustrates a cross-sectional view of the continuous liner 702 disposed in the shaped charge 120, in accordance with some embodiments of the present disclosure. As illustrated, the continuous liner 702 may have a hollow cone shape formed from the plurality of liner segments 312. As such, the continuous liner 702 may have a density gradient based at least in part on the respective density gradients, axial lengths, etc. of the liner segments 312. For example, the density of the continuous liner 702 may increase from a tip end 800 of the continuous liner 702 in a direction toward a base end 802 of the continuous liner 702. However, the density may decrease at a second portion 804 of the continuous liner 702, which was formed from the first intermediate liner segment 316. The density may then increase in the direction toward a third portion 806 of the continuous liner 702, which was formed from the second intermediate liner segment 318. Indeed, the continuous liner 702 may retain the density gradients of the plurality of liner segments 312 from which it was formed such that the continuous liner 702 may be formed with specific characteristics for perforating a target downhole material.

Figure 9:
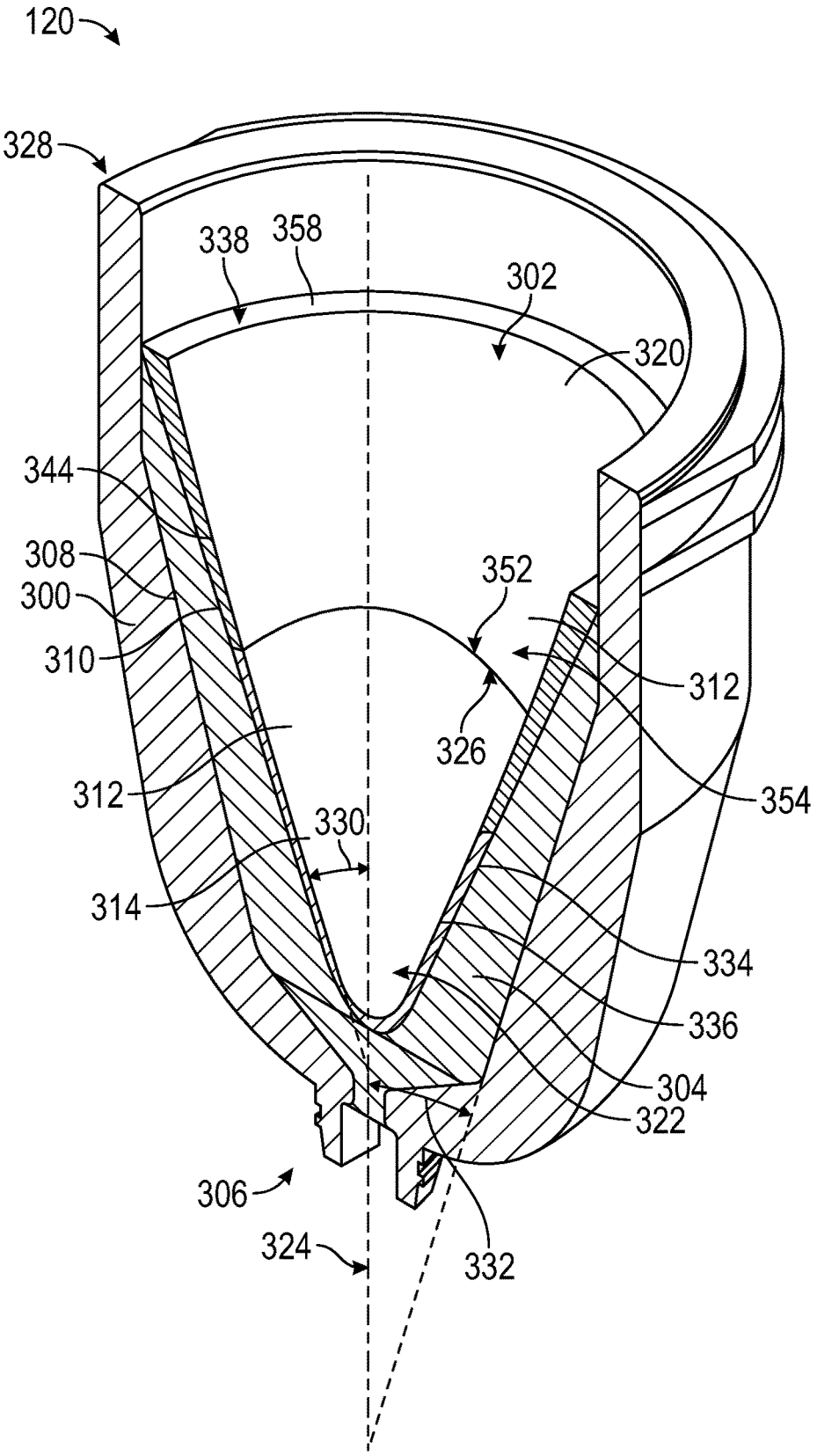
FIG. 9 illustrates a cutaway view of a shaped charge for the downhole perforating gun system, in accordance with some embodiments of the present disclosure.

FIG. 9 illustrates a cutaway view of a shaped charge 120 for the downhole perforating gun system, in accordance with some embodiments of the present disclosure. This figure shows shaped charge casing 300, segmented shaped charge liner 302, explosive material 304, initiating end 306, interior surface 308, exterior surface 310, liner segment 312, tip liner segment 314, base liner segment 320, first group 322, tip end 324, trailing interface end 326, base casing end 328, slant angle 330, casing slant angle 332, exterior surface 334, interior surface 336, base end 338, interior surface 344, second group 354, and trailing base end 358.

Accordingly, the present disclosure may provide segmented shaped charges and methods for forming segmented shaped charges used in downhole perforating guns systems for perforating downhole materials These systems and methods may include any of the various features disclosed herein, including one or more of the following statements.

Statement 1. A shaped charge liner, comprising: a plurality of liner segments for a shaped charge configured to perforate a sidewall of a wellbore upon detonation, wherein the plurality of liner segments comprises: a tip liner segment comprising a first group of compacted metal powder having a hollow cone shape with a trailing interface end disposed opposite a tip end, wherein the trailing interface end has a larger diameter than the tip end, and wherein the tip liner segment is configured to be disposed in a shaped charge casing of the shaped charge; and a base liner segment comprising a second group of compacted metal powder having a truncated hollow cone shape with a trailing base end disposed opposite a leading base interface end, wherein the trailing base end has a larger diameter than the leading base interface end, and wherein the base liner segment is configured to be disposed at least partially within the shaped charge casing.

Statement 2. The shaped charge liner of statement 1, wherein the plurality of liner segments are configured to stack in the shaped charge casing to form a hollow cone shape.

Statement 3. The shaped charge liner of statement 1 or statement 2, wherein each liner segment of the plurality of liner segments comprises at least one interface feature configured to interface with a corresponding interface feature of an adjacent liner segment in the shaped charge casing to restrain at least lateral movement between the liner segment and the adjacent liner segment.

Statement 4. The shaped charge liner of any preceding statement, wherein the at least one interface feature of each liner segment comprises a protrusion, a recess, or some combination thereof.

Statement 5. The shaped charge liner of any preceding statement, wherein each liner segment of the plurality of liner segments comprises a density gradient along an axial length of the liner segment.

Statement 6. The shaped charge liner of any preceding statement, wherein the density gradient comprises a first mean density between about 10 g/cm$^3$ to about 22 g/cm$^3$ at a leading end of each liner segment of the plurality of liner segments and a second mean density at a trailing end of each liner segment of the plurality of liner segments, wherein the second mean density is between about 95 percent to about 99 percent of the first mean density, and wherein the trailing end has a greater diameter than the leading end.

Statement 7. The shaped charge liner of any preceding statement, wherein an axial length of each liner segment is between about 12 percent to about 50 percent of a combined axial length of the plurality of liner segments.

Statement 8. The shaped charge liner of any preceding statement, wherein a thickness of each liner segment is between about 0.035 inches to about 0.11 inches.

Statement 9. The shaped charge liner of any preceding statement, wherein the first group of compacted metal powder and the second group of compacted metal powder each comprise at least one metal or at least one metal alloy powder selected from the group consisting of iron, steel, copper, brass, bronze, manganese, molybdenum, nickel, tungsten, bismuth, tin, lead, tantalum, aluminum, an alloy thereof, and combinations thereof.

Statement 10. The shaped charge liner of any preceding statement, where the plurality of liner segments further comprises at least one intermediate liner segment configured to be disposed between the tip liner segment and the base liner segment in the shaped charge casing, and wherein the tip liner segment, the intermediate liner segment, and the base liner segment are configured to stack in the shaped charge casing to form a hollow cone shape.

Statement 11. The shaped charge liner of any preceding statement, wherein the at least one intermediate liner segment comprises a first intermediate liner segment and a second intermediate liner segment, wherein the first intermediate liner segment is disposed adjacent the tip liner segment, and wherein the second intermediate liner segment is disposed adjacent the base liner segment.

Statement 12. A method of making a segmented shaped charge liner, comprising: placing a respective group of metal powder into each die of a plurality of dies; rotating each die of a plurality of dies to drive the respective groups of metal powder out and up corresponding inner walls of the plurality of dies via centrifugal force; and pressing a respective punch into each die of a plurality of dies to compact the respective groups of metal powder and form corresponding liner segments, wherein the liner segments are configured to stack in a shaped charge casing of a shaped charge that is configured to perforate a sidewall of a wellbore upon detonation.

Statement 13. The method of statement 12, wherein the plurality of dies comprise a cone shaped die configured to receive a corresponding cone shaped punch for forming a tip liner segment having a hollow cone shape, and wherein the plurality of dies further comprise at least one truncated cone shaped die configured to receive a corresponding truncated cone shaped punch for forming at least one liner segment having a hollow truncated cone shape.

Statement 14. The method of statement 12 or statement 13, wherein the plurality of dies comprise: a cone shaped die configured to receive a corresponding cone shaped punch for forming a tip liner segment having a hollow cone shape; a first truncated cone shaped die configured to receive a first truncated cone shaped punch for forming a first intermediate liner segment having a truncated hollow cone shape, wherein the first intermediate liner segment has a larger mean diameter than the tip liner segment; a second truncated cone shaped die configured to receive a second truncated cone shaped punch for forming a second intermediate liner segment having a truncated hollow cone shape, wherein the second intermediate liner segment has a larger mean diameter than the first intermediate liner segment; and a third truncated cone shaped die configured to receive a third truncated cone shaped punch for forming a base liner segment having a truncated hollow cone shape, wherein the base liner segment has a larger mean diameter than the second intermediate liner segment.

Statement 15. The method of any one of statements 12-14, further comprising the step of stacking the liner segments in the shaped charge casing to form a hollow cone shape liner disposed at least partially in the shaped charge casing.

Statement 16. The method of any one of statements 12-14, further comprising the steps of: stacking the liner segments within a secondary cone shaped die such that the stacked liner segments form a hollow cone shape; and pressing a secondary cone shaped punch into the secondary cone shaped die to merge the liner segments into a continuous liner configured to be disposed in a shaped charge casing.

Statement 17. The method of any one of statements 12-16, wherein rotating each die of a plurality of dies to drive the respective groups of metal powder radially outward and vertically up the corresponding inner walls of the plurality of dies via centrifugal force segregates metal particles of the respective groups of metal powder by density such that the liner segments comprise a density gradient along an axial length of each respective liner segment.

Statement 18. The method of any one of statements 12-18, wherein each die of the plurality of dies is oriented such that respective diameters of the corresponding inner walls of the plurality of dies increase in the upward direction.

Statement 19. A system for making a segmented shaped charge liner, comprising: a first press assembly comprising a cone shaped punch and a cone shaped die, wherein the cone shaped die is configured to receive a first group of metal powder, and wherein the cone shaped punch is configured to press the first group of metal powder against a first inner wall of the cone shaped die to compact the first group of metal powder and form a tip liner segment having a hollow cone shape; and a second press assembly comprising a truncated cone shaped punch and a truncated cone shaped die, wherein the truncated cone shaped die is configured to receive a second group of metal powder, and wherein the truncated cone shaped punch is configured to press the second group of metal powder against a second inner wall of the truncated cone shaped die to compact the second group of metal powder and form a base liner segment having a truncated hollow cone shape, wherein the tip liner segment and the base liner segment are configured to be disposed in a shaped charge casing of a shaped charge that is configured to perforate a sidewall of a wellbore upon detonation.

Statement 20. The system of statement 19, further comprising a secondary press assembly comprising a secondary cone shaped punch and a secondary cone shaped die, wherein the secondary cone shaped die is configured to receive the tip liner segment and the base liner segment, and wherein the secondary cone shaped punch is configured to press the tip liner segment and the base liner segment against a third inner wall of the secondary cone shaped die and against each other to form a continuous liner having a hollow cone shape configured to be disposed in a shaped charge casing of a shaped charge that is configured to perforate a sidewall of a wellbore upon detonation.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A shaped charge liner, comprising:

a plurality of liner segments for a shaped charge configured to perforate a sidewall of a wellbore upon detonation, wherein the plurality of liner segments comprises:

a tip liner segment comprising a first group of compacted metal powder having a hollow cone shape with a trailing interface end disposed opposite a tip end, wherein the trailing interface end has a larger diameter than the tip end, and wherein the tip liner segment is configured to be disposed in a shaped charge casing of the shaped charge; and a base liner segment comprising a second group of compacted metal powder having a truncated hollow cone shape with a trailing base end disposed opposite a leading base interface end, wherein the trailing base end has a larger diameter than the leading base interface end, and wherein the base liner segment is configured to be disposed at least partially within the shaped charge casing, wherein each of the plurality of liner segments has a distinct density gradient along an axial length of the liner segment, wherein each of the plurality of liner segments are stacked and pressed together to form a single continuous liner, and wherein a variation between the distinct density gradients determines a momentum gradient of the single continuous liner that thereby affects a desired jetting profile through the sidewall of the wellbore upon detonation.

2. The shaped charge liner of claim 1, wherein each liner segment of the plurality of liner segments comprises at least one interface feature configured to interface with a corresponding interface feature of an adjacent liner segment in the shaped charge casing to restrain at least lateral movement between the liner segment and the adjacent liner segment.

3. The shaped charge liner of claim 2, wherein the at least one interface feature of each liner segment comprises a protrusion, a recess, or some combination thereof.

4. The shaped charge liner of claim 1, wherein the density gradient comprises a first mean density between about 10 $g/cm^3$ to about 22 $g/cm^3$ at a leading end of each liner segment of the plurality of liner segments and a second mean density at a trailing end of each liner segment of the plurality of liner segments, wherein the second mean density is between about 95 percent to about 99 percent of the first mean density, and wherein the trailing end has a greater diameter than the leading end.

5. The shaped charge liner of claim 1, wherein an axial length of each liner segment is between about 12 percent to about 50 percent of a combined axial length of the plurality of liner segments.

6. The shaped charge liner of claim 1, wherein a thickness of each liner segment is between about 0.035 inches to about 0.11 inches.

7. The shaped charge liner of claim 1, wherein the first group of compacted metal powder and the second group of compacted metal powder each comprise at least one metal or at least one metal alloy powder selected from the group consisting of iron, steel, copper, brass, bronze, manganese, molybdenum, nickel, tungsten, bismuth, tin, lead, tantalum, aluminum, an alloy thereof, and combinations thereof.

8. The shaped charge liner of claim 1, where the plurality of liner segments further comprises at least one intermediate liner segment configured to be disposed between the tip liner segment and the base liner segment in the shaped charge casing, and wherein the tip liner segment, the intermediate liner segment, and the base liner segment are configured to stack in the shaped charge casing to form a hollow cone shape.

9. The shaped charge liner of claim 8, wherein the at least one intermediate liner segment comprises a first intermediate liner segment and a second intermediate liner segment, wherein the first intermediate liner segment is disposed adjacent the tip liner segment, and wherein the second intermediate liner segment is disposed adjacent the base liner segment.

10. The shaped charge liner of claim 1, wherein each of the plurality of liner segments has a distinct axial length based on a desired density gradient profile for the shaped charge liner.

11. The shaped charge liner of claim 10, wherein the desired density gradient profile is characterized by one or more step changes in density.

12. The shaped charge liner of claim 11, wherein the increased diameter of the trailing interface end relative to the tip end is based at least in part on a slant angle of the tip liner segment.

13. The shaped charge liner of claim 12, wherein an axial length of the tip liner segment is between 12 and 50 percent of a combined axial length of the plurality of liner segments.

14. The shaped charge liner of claim 13, wherein the tip liner segment further comprises graphite as lubricant.

15. The shaped charge liner of claim 10, wherein the plurality of liner segments comprises between 2 and 8 liner segments.

16. The shaped charge liner of claim 15, wherein the first group of compacted metal powder or the second group of compacted metal powder has at least one metal different from the other, wherein the difference further affects a desired jetting profile through the sidewall upon detonation.

17. The shaped charge liner of claim 1, wherein the base liner segment comprises pure copper or a copper and lead alloy; and the tip liner segment comprises tungsten.

18. The shaped charge liner of claim 17, wherein at least one liner segment of the plurality of liner segments is in a green state, wherein the green state comprises compaction of a liner segment into a desired shape without sintering or fusing.

19. The shaped charge liner of claim 1, wherein each of the plurality of liner segments has the same axial length.

* * * * *